US007631384B2

(12) United States Patent
Lecinq et al.

(10) Patent No.: US 7,631,384 B2
(45) Date of Patent: Dec. 15, 2009

(54) DEVICE FOR DAMPING VIBRATIONS OF A GUY-CABLE ARRAY FOR AN ENGINEERING CONSTRUCTION AND CORRESPONDING DAMPING METHOD

(75) Inventors: Benoit Lecinq, Fontenay-aux-Roses (FR); Jerome Stubler, Paris (FR); Sven Eilif Svensson, Birkerod (DK)

(73) Assignee: Freyssinet (FR)

( * ) Notice: Subject to any disclaimer, the term of this patent is extended or adjusted under 35 U.S.C. 154(b) by 188 days.

(21) Appl. No.: 10/578,818

(22) PCT Filed: Nov. 9, 2004

(86) PCT No.: PCT/FR2004/002880

§ 371 (c)(1),
(2), (4) Date: May 3, 2006

(87) PCT Pub. No.: WO2005/049923

PCT Pub. Date: Jun. 2, 2005

(65) Prior Publication Data

US 2007/0061982 A1 Mar. 22, 2007

(30) Foreign Application Priority Data

Nov. 12, 2003 (FR) ..... 03 13240

(51) Int. Cl.
*E01D 19/16* (2006.01)

(52) U.S. Cl. ..... 14/11

(58) Field of Classification Search ..... 14/22, 14/23; 174/42

See application file for complete search history.

(56) References Cited

U.S. PATENT DOCUMENTS

| | | | | |
|---|---|---|---|---|
| 3,463,870 | A * | 8/1969 | Eucker | 174/42 |
| 3,614,291 | A * | 10/1971 | Pullen | 174/42 |
| 3,784,723 | A * | 1/1974 | Cantamessa | 174/42 |
| 6,292,967 | B1 * | 9/2001 | Tabatabai et al. | 14/22 |
| 6,523,207 | B1 * | 2/2003 | Stubler et al. | 14/22 |
| 6,715,176 | B2 * | 4/2004 | Stubler et al. | 14/22 |
| 2002/0104175 | A1 * | 8/2002 | Zivanovic et al. | 14/22 |

(Continued)

FOREIGN PATENT DOCUMENTS

DE 33 43 352 C 6/1985

(Continued)

OTHER PUBLICATIONS

Patent Abstract of Japan. vol. 1998, No. 12, Oct. 31, 1998 & JP 10 195818 A (Kawada Kogyo KK, et al.) Jul. 28, 1998. Abstract, figures.

(Continued)

*Primary Examiner*—Raymond W Addie
(74) *Attorney, Agent, or Firm*—Banner & Witcoff, Ltd.

(57) ABSTRACT

Device for damping the vibrations of a sheet of stays of a work of construction, the sheet of stays comprising at least one first stay (4*a*) and one second stay (4*b*). The device comprises at least one damper (6) with substantially linear stroke, which has a first connection (7) articulated on the first stay (4*a*) and a second connection (8) articulated on the second stay (4*b*), and the axis of the damper (6) is substantially perpendicular to first and second stays (4*a*,4*b*).

13 Claims, 3 Drawing Sheets

U.S. PATENT DOCUMENTS

Figures 1, 2:
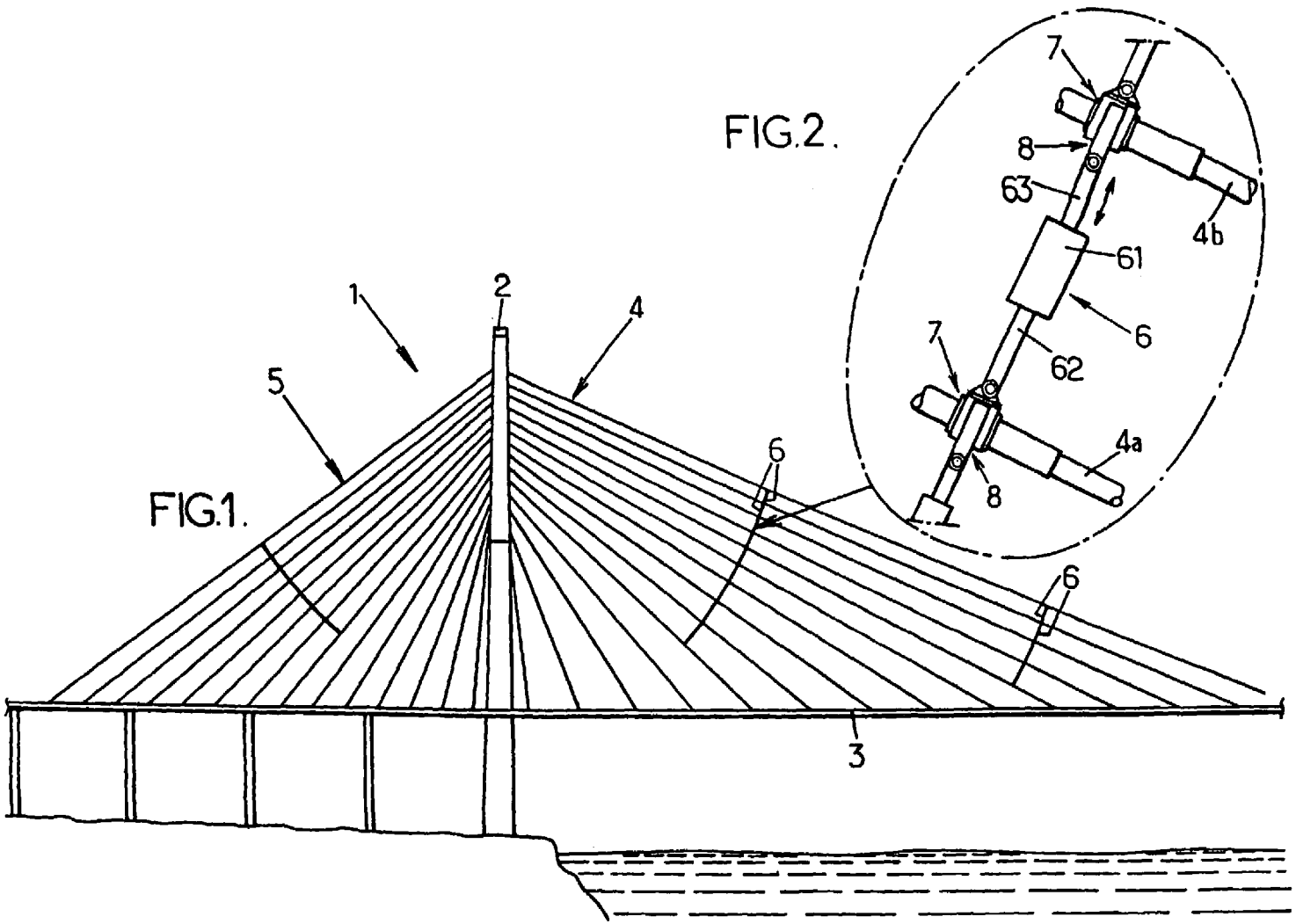

| | | | | |
|---|---|---|---|---|
| 2003/0086755 | A1 * | 5/2003 | Stubler et al. | 403/204 |
| 2003/0093869 | A1 | 5/2003 | Petersen | |

FOREIGN PATENT DOCUMENTS

| | | | |
|---|---|---|---|
| DE | 33 43 352 | C1 | 6/1985 |
| EP | 1013830 | * | 6/2000 |
| JP | 3-50609 | | 5/1991 |
| JP | 10 60816 | | 3/1998 |
| JP | 10 195818 | | 7/1998 |
| JP | 11 350429 | | 12/1999 |

OTHER PUBLICATIONS

Patent Abstract of Japan. vol. 2000, No. 03, Mar. 30, 2000 & JP 11 350429 A (Sumitomo Rubber Ind. Ltd.) Dec. 21, 1999. Abstract, figures.

Patent Abstract of Japan. vol. 1998, No. 08, Jun. 30, 1998 & JP 10 060816 A (Bridgestone Corp. et al.) Mar. 3, 1998. Abstract, figures.

* cited by examiner

DEVICE FOR DAMPING VIBRATIONS OF A GUY-CABLE ARRAY FOR AN ENGINEERING CONSTRUCTION AND CORRESPONDING DAMPING METHOD

CROSS REFERENCE TO RELATED APPLICATIONS

Applicant claims, under 35 U.S.C. .sctn. 120 and 365, the benefit of priority of the filing date of Nov. 9, 2004 of a Patent Cooperation Treaty patent application, Serial Number PCT/FR2004/002880, filed on the aforementioned date, the entire contents of which are incorporated herein by reference, wherein Patent Cooperation Treaty patent application Serial Number PCT/FR2004/02880 was not published under PCT Article 21(2) in English.

Applicant claims, under 35 U.S.C. .sctn. 119, the benefit of priority of the filing date of Nov. 12, 2003 of a French patent application, Serial Number FR 03 13240, filed on the aforementioned date, the entire contents of which are incorporated herein by reference.

The present invention relates to the devices for damping the vibrations of a sheet of stays of a work of construction and to the damping methods in which the damping of the vibrations of the sheet of stays is carried out by means of such devices.

More particularly, the damping device according to the invention may serve especially for damping the vibrations of a sheet of stays of a work of construction, such as a stayed bridge. In cable-stayed bridges, the cable stays forming the sheet of stays are generally anchored at their upper end on a pylon and at their lower end on the deck of the bridge. The sheet of stays thus ensures the hold and stability of the structure.

Nevertheless, under some conditions, especially when the deck of the bridge is subjected to periodic excitations, the stays may accumulate energy and oscillate considerably. The two main causes of these vibrations are the displacement of the anchorages of the stays with respect to the deck under the effect of traffic loads and the effect of the wind acting directly on the stays. These oscillations, when they are not controlled, are liable to damage the stays directly, whilst at the same time making the users who are on the deck of the bridge uneasy.

In order to avoid or limit the vibrations of the stays of a work of construction, it is known to use interconnection cables which make it possible to connect a plurality of stays of the same sheet of stays to one another, these interconnection cables, furthermore, being directly anchored on the deck of the bridge. These interconnection cables make it possible to stiffen the whole of the sheet of stays, whilst making it possible to prevent some modes of vertical vibration of the said stays.

Nevertheless, when interconnection cables are used to connect a plurality of stays to one another, it is appropriate to take the following parameters into account:

- the cross section, rigidity and tension of the interconnection cables must be determined by means of an overall calculation of the sheet of interconnected stays;
- the resistance of the interconnection cables and of their anchorages must be adapted to the situations of extreme load, such as road traffic on the deck of the bridge, or of a turbulent wind on the work of construction or on the stays;
- the pretension of the interconnection cables must make it possible to avoid any de-tension under extreme load; to be precise, a de-tensioned interconnection cable no longer performs its function and may undergo shocks harmful to the durability of the anchorages, which is likewise liable to give rise to a break of the said interconnection cable and therefore to its replacement by another interconnection cable having a higher cross section and rigidity, whilst being tensioned to a higher tension value;
- the angular fractures of the ends of the stays in the region of the anchorages must likewise be evaluated and, if appropriate, corrected.

Taking into account these various parameters thus to a relatively great extent complicates the installation of these interconnection cables in order to stiffen the sheet of stays of a work of construction.

Moreover, when these interconnection cables have to be installed after the work of construction has been put into operation, for example in order to correct stability problems, it is essential, as described above, to pretension the whole of the interconnection cables, thus modifying the geometry of the various stays of the sheet of stays, with consequences for the structure of the work of construction and, especially, the occurrence of angular fractures in the region of the ends of the stays directly anchored on the pylon and on the deck of the bridge, where stayed bridges are concerned.

To satisfy these constraints, before or after the work of construction is put into operation, interconnection cables are sometimes used which are formed from a plurality of strands wound around a polymer core, each strand itself being formed by a plurality of metal wires. The use of such strands wound around a polymer core imparts a low rigidity and a high damping capacity to the interconnection cable when the latter is subjected to a variable tension. Nevertheless, these twisted interconnection cables have an appreciable effect on the geometry of the interconnected stays.

Another solution involves using dampers arranged between the stays and the structure of the work of construction, these dampers being capable of dissipating the vibrational energy of the stays. Such dampers are described especially in the documents FR 2 631 407 and FR 2 664 920. In order to be effective, these dampers must act between a fixed point connected to the work of construction, usually the deck, and a moveable point of the corresponding stay. For practical reasons, these dampers are located in the vicinity of the lower or upper anchorage of the corresponding stay, but their damping capacity is limited considerably by the low amplitude of the displacements of the ends of the stays in the vicinity of their anchorage.

The object of the present invention is especially to overcome the abovementioned disadvantages.

For this purpose, the subject of the invention is a device for damping the vibrations of a sheet of stays of a work of construction, the sheet of stays comprising at least one first stay and one second stay, characterized in that the device comprises at least one damper with substantially linear stroke, which has a first connection articulated on the first stay and a second connection articulated on the second stay and in that the axis of the damper is substantially perpendicular to the first and second stays, in such a way that its damping stroke is substantially perpendicular to the first and second stays.

By virtue of these arrangements, a damper, as defined above, can therefore be arranged directly on the middle portions of two adjacent stays, in the region of which middle portions the vibration amplitude is the highest. Moreover, the fact that two adjacent stays of the same sheet of stays do not have the same length or the same mass per unit length or the same tension implies that each stay has a characteristic frequency which is different from that of the directly adjacent stay. Thus, two adjacent stays do not vibrate in phase, and the damper with substantially linear stroke therefore undergoes variations in length which allow it to dissipate the energy, consequently damping the vibrations of the two adjacent stays.

Further, the fact that the axis of the piston damper forms an angle of 90° with the two stays permits to avoid introducing longitudinal forces, that is to say forces in the axis of the stays, into, the first and second connections which could cause these to slide along the stays.

In preferred embodiments of the invention, furthermore, use may be made, if appropriate, of one and/or the other of the following arrangements:

- the damper with substantially linear stroke comprises a piston body and a piston mounted moveably with respect to the piston body, the said piston body being provided with the first articulated connection, and the piston being provided with the second articulated connection;
- the first and second connections each comprise a collar, mounted around the stay associated with it, and a pivot connection which connects the collar to the damper;
- the pivot connection is a connection with a pivot perpendicular to the longitudinal direction of the corresponding stay and to the plane containing the first and second stays;
- each collar is mounted, clamped, around the stay associated with it;
- each collar is mounted pivotally around a support mounted, clamped, on the stay associated with it;
- each collar is attached pivotally around the support with a predetermined coefficient of friction, so as to allow a rotational damping of each collar around the support during the displacements of the corresponding stay in a direction perpendicular to the plane containing the first and second stays;
- the sheet of stays comprises a plurality of stays arranged in the same plane and a plurality of dampers which connect at least some adjacent stays to one another; and two consecutive dampers, which connect a middle stay to two directly adjacent stays, comprise articulated connections located on the same predetermined zone of the said middle stay.

Moreover, the subject of the invention is also a method for damping the vibrations of a sheet of stays of a work of construction, characterized in that the damping of the vibrations is carried out by means of a device, as defined above.

Figure 6:
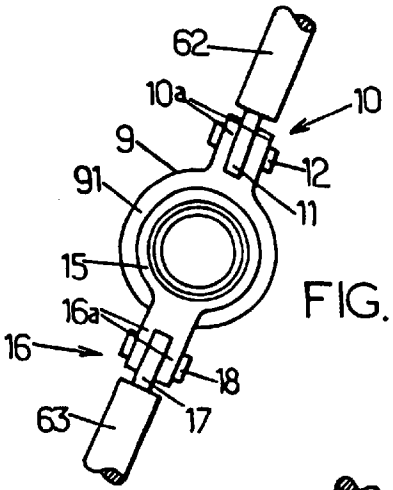
Figure 7:
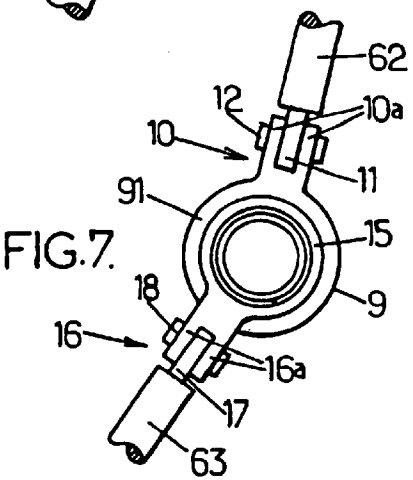
Figure 5:
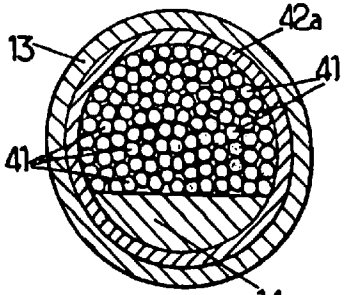
Figure 3:
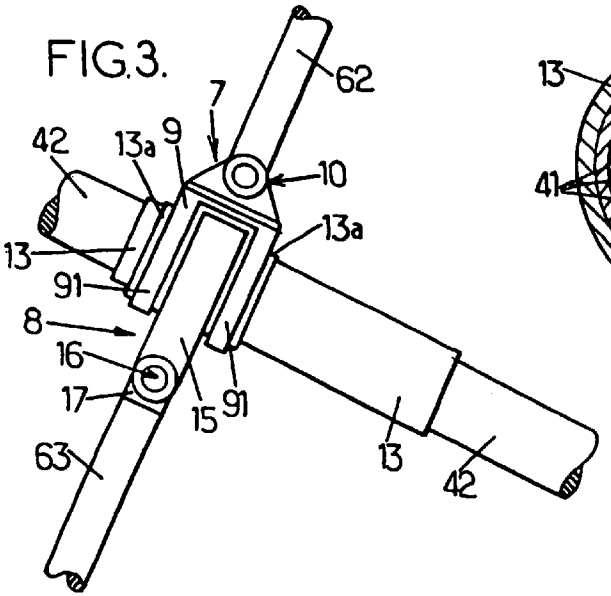
Figure 4:
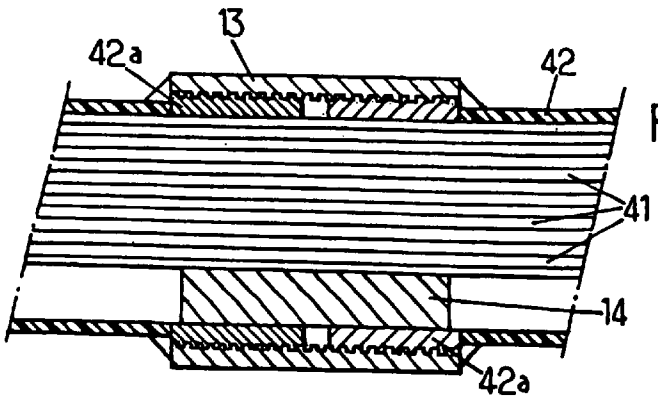
Figure 8:
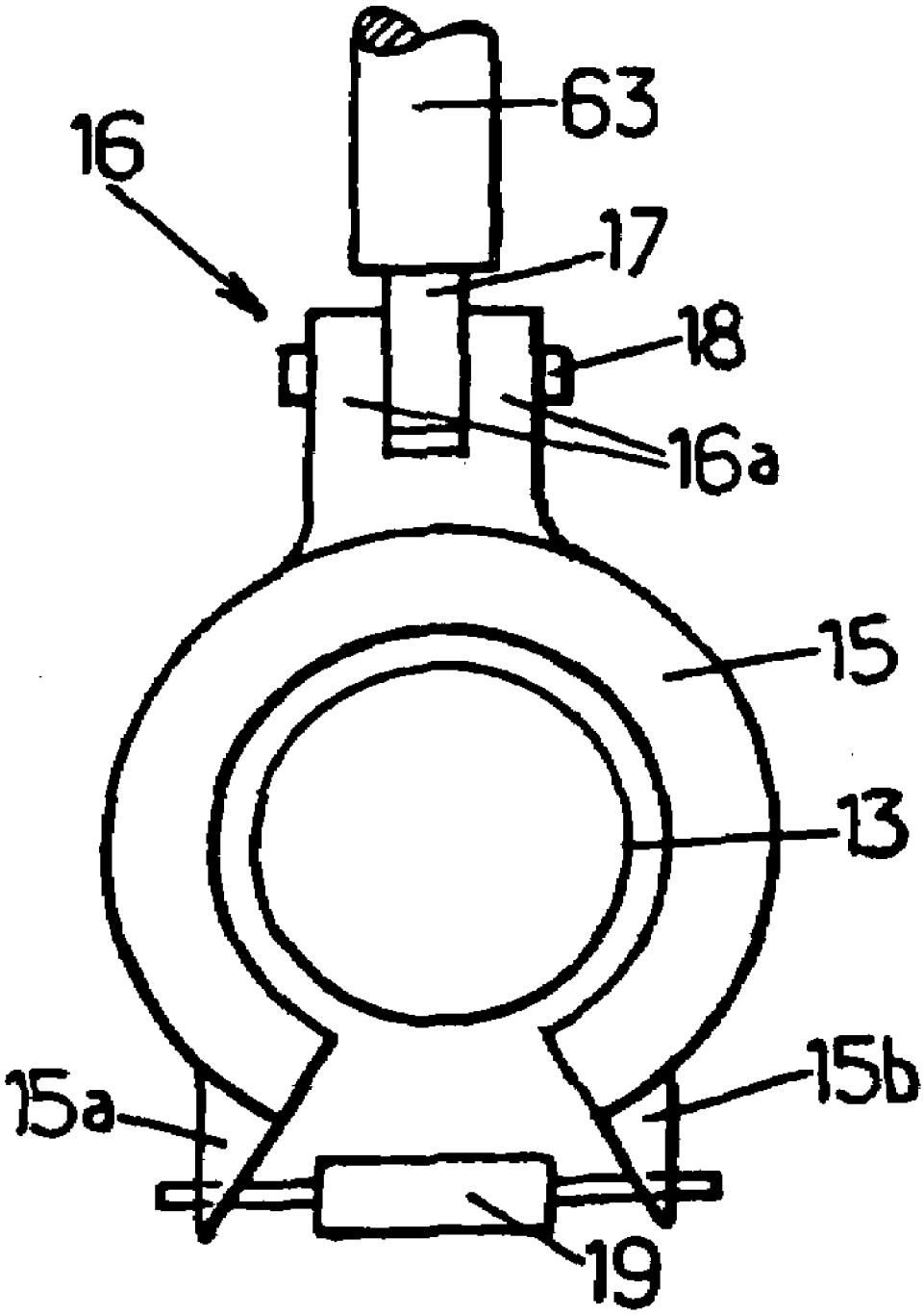

Other characteristics and advantages of the invention will become apparent from the following description of several embodiments given by way of non-limiting example, with reference to the accompanying drawings in which:

FIG. 1 illustrates a work of construction, such as a stayed bridge, provided with a plurality of devices for damping the vibrations of a sheet of stays, FIG. 2 illustrates a device according to the invention for damping the vibrations of two adjacent stays of the same sheet of stays, FIG. 3 illustrates an enlarged view of the articulated connections of two dampers mounted to the same stay, FIG. 4 illustrates a view in longitudinal section of a portion of a stay intended for receiving at least one articulated connection of a damper, FIG. 5 illustrates a cross-sectional view of that portion of the stay which is intended for receiving at least one articulated connection of a damper, FIG. 6 illustrates a side view of that portion of the device which is illustrated in FIG. 3, when the stay does not undergo any transverse displacement, FIG. 7 illustrates a side view of that portion of the device which is illustrated in FIG. 3, when the stay undergoes a transverse displacement, and FIG. 8 illustrates an alternative embodiment of the connection of one end of a damper to a stay.

The same references designate identical or similar elements in the various figures.

FIG. 1 illustrates a work of construction which takes the form of a stayed bridge 1 which comprises at least one pylon 2, a deck 3 and, in the example considered here, two sheets of stays 4 and 5 which connect the deck 3 to the pylon 2.

The sheets of stays 4 and 5 are used to support that part of the deck 3 which does not rest on supporting pylons (that part of the deck which is located on the right of the pylon 2 in the example considered here).

The sheet of stays 4 is formed by a set of cable stays which are inclined downwards and towards the right, each stay having an upper end anchored in a respective anchoring zone arranged on the pylon 2 and a lower end anchored on the deck 3. The sheet of stays 5 likewise comprises a set of stays inclined downwards and towards the left, each stay of this sheet of stays 5 having an upper end directly anchored in a respective anchoring zone arranged on the pylon 2 and a lower end anchored on the deck 3. In a way known per se, and as can be seen from FIGS. 4 and 5, each stay is formed from a bundle of metal strands 41 which are anchored at their two ends and from a plastic sheath 42 which surrounds and protects the bundle of metal strands 41 from the outside and especially from corrosion. This sheath 42 may be produced, for example, from high-density polyethylene (HDPE).

FIG. 2 illustrates a detailed view of a portion of the sheet of stays 4 and, more particularly, of a first stay 4*a* and of a second stay 4*b* which are connected to one another by means of a damping link 6 according to the invention. This damping link 6 takes the form of a damper 6 which has a substantially linear stroke and which comprises a first connection 7 articulated on the first stay 4*a* and a second connection 8 articulated on the second stay 4*b* directly adjacent to the first stay 4*a*.

This damper 6 may be of the viscous-damper type, especially a hydraulic-piston damper, or of the friction-damper type comprising a piston intended to be displaced frictionally with respect to a piston body. FIG. 2 illustrates a piston damper 6 which comprises, on the one hand, a piston body 61 which is prolonged, in the direction of the first stay 4*a*, by a metal tube 62 which is itself provided with the first connection 7, and, on the other hand, a piston 63 intended to be displaced within the piston body 61 according to a linear stroke, this piston 63 being provided with the second connection 8. The piston damper 6 used for damping the vibrations of two adjacent stays may especially be similar to those used for lorries or trains, this damper being capable of being prolonged by metal bars or tubes, themselves provided with articulated connections 7 and 8. Moreover, efficient damping is promoted by the use of hydraulic dampers, the law of damping of which may, for example, be linear, quadratic or the like.

Contrary to the known interconnection cables which have to be pretensioned in order to prevent de-tensions or shocks, the piston dampers 6 do not have a permanent normal force, the piston 63 adjusting itself to the distance at rest between the first and second stays 4*a*, 4*b*, without exerting any force. This characteristic of the piston dampers 6 is advantageous with regard to the interconnection cables which deflect the stays downwards due to their preloading, thus reducing the effectiveness of the stays, thereby often making it necessary to add additional strands in these stays. Furthermore, it is possible to place the piston dampers 6 between two stays or more, but without connecting these stays to the deck 3, thus economizing on the anchorages on the deck. Moreover, in contrast to a conventional interconnection cable, the piston damper 6 is capable of transmitting tensile and compression forces, but also bending forces.

As can be seen from FIG. 2, the first and second stays 4*a*, 4*b* can also be connected to the stays which are directly adjacent to them by means of piston dampers 6 strictly identical to that which connects the said first and second stays 4*a*, 4*b*. In this case, each piston damper 6 will be provided with a first connection 7 or lower connection 7 directly articulated on the stay which is below it and with a second connection 8 or upper connection directly articulated on the stay which is above it. Thus, when a given middle stay is connected to the stay which is directly above it and to the stay which is directly below it, this middle stay is provided with a first connection 7 and with a second connection 8.

As can be seen from FIGS. 1 and 2, each piston damper 6 is arranged substantially perpendicularly with respect to the two stays which it connects. When the stays of the same sheet are all parallel to one another, each piston damper 6 forms an angle of 90° with the two stays, in order to avoid introducing longitudinal forces, that is to say forces in the axis of the stays, into the first and second connections 7, 8, which could cause these to slide along the stays. When the stays of the same sheet are not strictly parallel to one another, as illustrated in FIG. 1, each damper 6 is arranged perpendicularly to the bisector of the angle formed by the two stays which it connects. Consequently, when a plurality of piston dampers 6 are arranged in succession on a plurality of stays, as illustrated in FIG. 1, the trace of the piston dampers in elevation has a substantially curved shape.

As can be seen in more detail from FIGS. 3 to 7, the first connection 7 of each piston damper 6 comprises a steel collar 9, mounted around the stay associated with it, and a pivot connection 10 which connects the collar 9 to the piston damper 6 or, more particularly, to the metal tube 62 directly connected to the piston body 61 of the said piston damper 6.

The pivot connection 10 takes the form of a female yoke comprising two flanges 10*a* which extend upwards from the collar 9 and in which are formed respectively two holes which are arranged opposite one another and along an axis perpendicular to the axis of the stay. The metal tube 62 of the piston damper 6 comprises, itself, an end taking the form of a male yoke 11 arranged between the two flanges 10*a* of the female yoke, the male yoke 11 likewise comprising a hole arranged so as to correspond mutually with the holes of the female yoke. The male and female yokes are connected to one another by means of a pin 12 which extends perpendicularly to the axis of the stay.

In the example considered here, the collar 9 takes the form of two parallel flanges 91 provided with circular orifices which directly surround the stay. For this purpose, the stay is provided with a metal tube 13, onto which the collar 9 is intended to be mounted. In order to install this metal tube 13, the sheath 42 is cut, and two portions 42*a* produced from HDPE are fastened respectively to the two cut ends of the sheath 42. These two portions 42*a*, which each have a thickness greater than the thickness of the sheath 42, are each provided with an external thread intended for co-operating by screwing with an internal thread formed on the metal tube 13.

Moreover, a wedge 14 is likewise attached directly inside the sheath 42 prior to the screwing of the metal tube 13 onto the two portions 42*a*. The function of this wedge 14 is to clamp the metal strands 41 against the two portions 42*a* with minimum play. After this wedge 14 has been installed, the metal tube 13 is screwed onto the two portions 42*a* and then finally fastened, for example by welding.

The collar 9 or, more precisely, its two flanges 91 can then be mounted to the metal tube 13.

When the collar 9 is mounted to the metal tube 13 before the work of construction is put into operation, the flanges 91 can be fitted on at one of the ends of the corresponding stay and then moved in translational motion as far as the metal tube 13. Conversely, when the collar 9 is attached to the metal tube 13 after the work of construction is put into operation, each flange 91 can be formed by a first semi-cylindrical half-flange produced in one piece with the pivot 10 and by a second semi-cylindrical flange. These two half-flanges will then be mounted around the metal tube 13 and then fastened to one another, for example by screwing, in order to form the collar 9.

The two flanges 91 of the collar 9 are subsequently blocked in terms of translational motion on the metal tube 13 by means of two stops 13*a* arranged on either side of the two flanges 91, these stops being capable of being mounted and directly welded to the cylindrical tube 13.

The second connection 8 of each piston damper 6 likewise comprises a steel collar 15, mounted around the stay associated with it, and a pivot connection 16 which connects the collar 15 to the piston damper 6. The pivot connection 16 likewise takes the form of a female yoke comprising two flanges 16*a* which extend downwards from the collar 15 and in which are formed respectively two holes which are arranged opposite one another and along an axis perpendicular to the axis of the stay. The piston 63 of the piston damper 6 has, itself, an end taking the form of a male yoke 17 arranged between the two flanges 16*a* of the female yoke, the male yoke 17 likewise having a hole arranged so as to correspond with the holes of the female yoke. The male and female yokes are connected to one another by means of a pin 18 which extends perpendicularly to the axis of the stay.

In the example considered here, the collar 15 takes the form of a single flange arranged between the two flanges 91 of the collar 9. This flange 15 comprises a circular orifice which directly surrounds the stay or, more precisely, the cylindrical tube 13. Depending on whether the collar 15 is mounted to the metal tube 13 before or after the work of construction is put into operation, the collar 5 can be formed in one piece or in two pieces, as described above with regard to the collar 9.

The collars 9 and 15 of the first and second connections 7 and 8 therefore completely surround the stays to which they are mounted, whilst at the same time being connected to a piston damper 6 by means of a pivot connection 10 or 16 having a pivot axis solely perpendicular to the axis of the stay and to the plane containing the stays. Thus, the force exerted by each piston damper is applied by means of the collar 9 or 15 to the cylindrical tube 13, at the centre of the latter, that is to say at the centre of gravity of the cross section of the corresponding stay, thus avoiding any risk of geometric instability which could lead to the twisting of at least one of the stays. Of course, the metal tube 13 must be capable of withstanding the shearing forces which occur between the collar 9 and the collar 15.

When the dampers 6 are intended for damping only the vertical displacements of the stays, the collars 9 and 15 may be directly fastened around the metal tube 13 without any degree of freedom in terms of rotation about the said metal tube. According to another alternative embodiment, the collars 9 and 15 may be mounted pivotally with minimum friction around the metal tube 13 by means of a suitable lubricant, as illustrated in FIGS. 6 and 7. In this case, each of the first and second connections 7, 8 is formed by a pivot connection 10, 16 perpendicular to the axis of the corresponding stay and by another pivot connection which is formed by the tube 13 and each collar and which is centred and parallel to the axis of the corresponding stay.

If the collars 9 and 15 are mounted pivotally about the tube 13 with minimum friction, the first and second connections 7 and 8 thus each form connections having two pivots with two degrees of freedom, which are similar to ball-joint connections, without thereby having the disadvantages of ball-joint connections which, in the present case, would give rise to a geometric instability associated with the fact that the force exerted by each piston damper would no longer be applied to the centre of gravity of the cross section of the corresponding stay.

It may also prove advantageous to damp the transverse vibrations of the stays in the plane perpendicular to the plane containing the set of stays.

For this purpose, the collars 9 and 15 of the first and second connections 7 and 8 are mounted pivotally to the metal tube 13 with a predetermined coefficient of friction, in order to allow a rotational damping of the transverse displacements of the said stays by means of controlled friction between the metal tube and the collars 9, 15. For this purpose, the inner walls of the circular orifices of the collars 9 and 15 and the outer wall of the metal tube 13 may be adapted so as to have a frictional surface of which the frictional force is controlled by means of a suitable choice of materials. The presence of a suitable friction lining directly interposed between the collars 9, 15 and the metal tube 13 may likewise make it possible to limit the transverse displacements of the stays by means of rotational damping. The materials which are in contact must have long-lasting anti-wear properties, such as "Metaloplast", and ensure a constant coefficient of friction over time.

FIG. 8 illustrates an alternative embodiment of the pivot connection between the metal tube 13 and the collar 15 in order to limit the transverse vibrations of the stays by means of rotational damping between the collar 15 and the tube 13 integral with the stay.

This collar 15, mounted pivotally on the metal tube 13, takes the form of an open collar comprising two free ends 15*a*, 15*b* which are connected to one another by means of an adjustable clamping system 19. This adjustable clamping system 19 may, for example, take the form of a spring system, a Belleville washer system or of a jack acting so as to bring the ends 15*a*, 15*b* towards one another in such a way as to control the clamping of the said collar 15 against the metal tube 13. The clamping adjustment makes it possible to modify the coefficient of friction between the inner surface of the collar 15 and the outer surface of the cylindrical tube 13, thus modifying the transverse damping of the stay or of the plurality of stays which will be interconnected by means of the piston dampers 6.

Of course, this embodiment of the collar 15 may also be used for the flanges 91 of the collar 9.

Instead of controlled friction being established between the collars 9 and 15 and the metal tube 13, it is also possible to employ other dissipative processes for damping the transverse displacements of the stays. It is possible, for example, to provide for the metal tubes 62, which connect the piston dampers 6 to the first and second connections, to have a controlled-inertia section so as to be deformed in the event of a transverse displacement of a stay. To be precise, it is known that the deformations of a metal bar bent in the plastic range are accompanied by a dissipation of energy.

This alternative embodiment, which involves the deformation of the metal tubes or bars connecting the dampers to their first and second connections, is used when the collars 9 and 15 are mounted fixedly with respect to the tube 13.

The invention claimed is:

1. A device for damping the vibrations of cable stays comprising in combination: one first stay and one second stay;

at least one damper with a substantially linear stroke defining an axis;

a first articulated connection for said damper to the first stay and a second articulated connection for said damper to the second stay to maintain the axis of the damper aligned substantially perpendicular to the first and second stays.

2. A device according to claim 1 in which the damper comprises a piston body and piston mounted moveably with respect to the piston body, said piston body attached to the first articulated connection, and the piston attached to the second articulated connection.

3. A device according to claim 1 in which at least one of the first and second connections comprise a collar mounted around the attached stay and a pivot connection connecting the collar to the damper.

4. A device according to claim 3 in which the pivot connection is connected to a pivot substantially perpendicular to the longitudinal direction of the corresponding stay and to a plane containing the first and second stays.

5. A device according to claim 3 in which said collar is mounted around the associated stay.

6. A device according to claim 3 in which said collar is mounted pivotally around a support mounted on the associated stay.

7. A device according to claim 6, in which said collar is mounted pivotally around the support with a predetermined coefficient of friction to rotationally damp said collar around the support during the displacements of the associated corresponding stay in a direction generally perpendicular to a plane containing the first and second stays.

8. A device according to claim 1 comprising a plurality of stays arranged in the same plane and a plurality of dampers which connect at least some adjacent stays to one another.

9. A device according to claim 8 comprising two consecutive dampers, connecting respectively a middle stay to a directly adjacent stays, said dampers each connected to a same pre-determined zone of said middle stay.

10. Method for damping the vibrations of a sheet of stays (4) of a work of construction (1), characterized in that the damping of the vibrations is carried out by means of a device (6) according to any one of the preceding claims.

11. A device according to claim 1 in which the first and second connections each comprise a collar mounted around the respective attached stay and further including a pivot connection for each collar connecting to the damper.

12. A method for damping the vibrations of at least two adjacent stays comprising the steps of:

placing a damping mechanism having a substantially linear stroke defining an axis intermediate said stays, said damping mechanism including a first end attached to one of said stays by a first connection device and a second end attached to the other of said stays by a second connection device, said damping mechanism maintaining a damping stroke substantially perpendicular simultaneously to the stays.

13. The method of claim 12 wherein the connection devices each comprise a collar fitted on each said respective stay.

* * * * *

UNITED STATES PATENT AND TRADEMARK OFFICE

CERTIFICATE OF CORRECTION

PATENT NO. : 7,631,384 B2
APPLICATION NO. : 10/578818
DATED : December 15, 2009
INVENTOR(S) : Lecinq et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 414 days.

Signed and Sealed this

Second Day of November, 2010

David J. Kappos

David J. Kappos
*Director of the United States Patent and Trademark Office*